US006133675A

United States Patent [19]

Enomoto et al.

[11] Patent Number: 6,133,675

[45] Date of Patent: Oct. 17, 2000

[54] CATHODE RAY TUBE WITH INTEGRAL REAR ENVELOPE

[75] Inventors: Takashi Enomoto; Takashi Nishimura, both of Fukaya, Japan

[73] Assignee: Kabushiki Kaisha Toshiba, Kawasaki, Japan

[21] Appl. No.: 09/086,288

[22] Filed: May 29, 1998

[30] Foreign Application Priority Data

May 30, 1997 [JP] Japan ..... 9-142599

[51] Int. Cl.[7] ..... H01J 31/00

[52] U.S. Cl. ..... 313/2.1; 313/477 R; 445/45

[58] Field of Search ..... 313/2.1, 477 R; 445/22, 44, 45

[56] References Cited

U.S. PATENT DOCUMENTS

| | | | |
|---|---|---|---|
| 4,712,038 | 12/1987 | Takenaka et al. | 313/2.1 |
| 4,714,856 | 12/1987 | Takenaka et al. | 313/2.1 |
| 4,777,407 | 10/1988 | Takenaka et al. | 313/2.1 |
| 5,032,756 | 7/1991 | Takenaka et al. | 313/2.1 |
| 5,365,142 | 11/1994 | Nishimura et al. | 313/2.1 |
| 5,751,094 | 5/1998 | Nishimura et al. | 313/2.1 |
| 5,831,373 | 11/1998 | Takahashi et al. | 313/2.1 |

FOREIGN PATENT DOCUMENTS 5-36363 2/1993 Japan .

*Primary Examiner*—Nimeshkumar D. Patel
*Assistant Examiner*—Michael J. Smith
*Attorney, Agent, or Firm*—Pillsbury Madison & Sutro LLP

[57] ABSTRACT

A vacuum envelope includes a flat face plate having a phosphor screen formed on the inner surface of the face plate, and a flat rear plate opposed to the face plate with a side wall interposed therebetween. A plurality of funnels extend from the rear plate, and electron guns are respectively enclosed in the necks of the funnels. The rear plate and the plurality of funnels are integrally formed of one single plate glass and are joined to face plate through the side wall. A plurality of reference surfaces are formed on the inner surface of the rear plate, and ends of the plate support members are respectively fixed to the reference surfaces.

14 Claims, 8 Drawing Sheets

CATHODE RAY TUBE WITH INTEGRAL REAR ENVELOPE

The present invention relates to a cathode ray tube which comprises a flat face plate having a phosphor screen formed on the inner surface thereof, a flat rear plate opposed to the face plate, and a plurality of electron guns equipped on the rear plate, and which dividedly scans a plurality of regions of the phosphor screen.

In recent years, various discussions and studies have been made in relation to high-definition broadcasting or a cathode ray tube of a high resolution having a large screen which responds to such broadcasting. In order to achieve a high resolution, the beam spot diameter of each electron beam on the phosphor screen must generally be reduced.

In this respect, improvements in the electrode structure of an electron gun or enlargement and extension of the diameter of an electron gun itself have been attempted, but have not reached satisfactory results. This is because the distance from an electron gun to a phosphor screen increases as the size of a cathode ray tube is enlarged, so that the magnification of the electron lens is enlarged too much. Therefore, the distance (or depth) from an electron gun to a phosphor screen must be reduced to achieve a high resolution. In addition, a widened deflection angle of an electron beam leads to an increase of a difference in magnification between the center of a screen and the periphery thereof. Deflection at a widened angle is thus not a better way to achieve a high resolution.

Hence, developments have been made to a cathode ray tube as a solution for the problem of a conventional cathode ray tube as described above, for example, Japanese Patent Application KOKAI Publication No. 5-36363 discloses a cathode ray tube wherein a face plate and a rear plate are flattened, and a plurality of regions of a phosphor screen with an integrated structure formed on the inner surface of the face plate are dividedly scanned by electron beams emitted from a plurality of electron guns which are attached to the rear plate.

More specifically, this kind of cathode ray tube comprises a flat face plate and a rear plate made of glass and opposed in parallel to each other, and a side wall made of glass is joined to the periphery of the face plate so as to extend vertically, for example, using a joining material such as frit glass or the like. The rear plate is fixed to the face plate through the side wall. A plurality of rectangular openings are formed in the rear plate, corresponding to a plurality of regions to be scanned dividedly. Also, a plurality of funnels are fixed by a joining material, to the rear plate so as to surround the respective openings, and the electron guns are respectively arranged in the necks of the funnels.

Further, a plurality of regions of the phosphor screen with an integrated structure formed on the inner surface of the face plate are dividedly scanned by electron beams emitted from the plurality of electron guns. Images respectively displayed on the regions by the divisional scanning are connected together by controlling signals applied to the electron guns or deflectors equipped so as to correspond to the electron guns, so that a seamless image is reproduced over the entire regions of the phosphor screen, without an overlap.

In a cathode ray tube wherein a plurality of regions of the phosphor screen are dividedly scanned by electron beams emitted from a plurality of electron guns, as described above, the electron guns must be correctly situated at predetermined positions such that the axes of the electron guns pass through the respective centers of the corresponding regions, in order to set the raster of each region to a predetermined size and thereby to obtain an image without seams and overlaps between adjacent regions.

However, it is not easy but very difficult to join a plurality of funnels to the rear plate with high precision such that the axes of the electron guns enclosed in the necks of the funnels pass through the respective centers of the regions. Further, the plurality of funnels and the side wall must be fixed to the rear plate made of glass by a joining material, and joining portions thereof become factors which decrease positional precision of respective components, as well as reliability concerning withstand-voltage characteristics and vacuum-air-tightness characteristics.

BRIEF SUMMARY OF THE INVENTION

The present invention has been made in consideration of the respects described above and its object is to provide a cathode ray tube in which a plurality of funnels are joined to a flat rear plate opposing a flat face plate, and a plurality of regions of a phosphor screen with an integrated structure formed on the inner surface of the face plate are dividedly scanned by electron beams emitted from a plurality of electron guns enclosed in necks of the funnels, and wherein the plurality of funnels can be set at predetermined positions with high precision and the withstand-voltage characteristics and vacuum density characteristics can be improved, and to provide a method of manufacturing the same.

In order to achieve the object described above, a cathode ray tube according to the present invention comprises: an envelope including a substantially rectangular flat face plate having a phosphor screen formed on an inner surface thereof, a substantially rectangular flat rear plate opposed to the face plate with a frame-like side wall interposed therebetween, a plurality of funnels extending from the rear plate, and a plurality of necks respectively extending from the funnels; and a plurality of electron guns respectively arranged in the necks, for dividedly scanning a plurality of regions of the phosphor screen by electron beams. The rear plate and the plurality of funnels are integrally formed of a single plate glass and constitute a rear envelope, and the rear envelope is joined to the face plate through the side wall.

A method of manufacturing a cathode ray tube comprising a substantially rectangular flat face plate having a phosphor screen formed on an inner surface thereof, a substantially rectangular flat rear plate opposed to the face plate with a frame-like side wall inserted therebetween, a plurality of funnels extending from the rear plate, a plurality of necks respectively extending from the funnels, and a plurality of electron guns respectively provided in the necks, for dividedly scanning a plurality of regions of the phosphor screen by electron beams is characterized by comprising the steps of: manufacturing a rear envelope by integrally forming the rear plate and the plurality of funnels from one single plate glass; and joining the rear envelope to the face plate through the side wall by a joining material.

According to the cathode ray tube and the manufacturing method thereof described above, the rear plate and the funnels need not be joined with use of a joining material, but are formed integrally from a plate glass. Therefore, the plurality of funnels can be positioned on the rear plate with high precision. As a result, the axes of the electron guns enclosed in the necks of the funnels can respectively be positioned so as to pass through the centers of the regions to be dividedly scanned. In addition, since joining surfaces of respective members are reduced by thus adopting integral formation, the reliability concerning withstand-voltage characteristics and vacuum air-tightness can be greatly improved, and materials and manufacturing steps associated with joining of components can be reduced.

In addition, with the cathode ray tube and the manufacturing method thereof according to the present invention described above, the rear envelope is constructed by integrally forming a rear plate, a plurality of funnels, and a side wall from glass. In this case, joining surfaces of respective members are reduced much more so that the reliability concerning voltage-withstand characteristics and vacuum air-tightness are improved and manufacturing costs are reduced.

Further, the cathode ray tube according to the present invention comprises a plurality of plate support members provided between the rear plate and the face plate, for supporting the rear plate and the face plate against an atmospheric pressure. The rear plate comprises a substantially rectangular inner surface opposed to the face plate, and a plurality of reference surfaces formed on the inner surface, to which ends of the plate support members are respectively fixed.

In addition, a method of manufacturing a cathode ray tube according to the present invention, comprising a substantially rectangular flat face plate having a phosphor screen formed on an inner surface thereof, a substantially rectangular flat rear plate opposed to the face plate with a frame-like side wall inserted therebetween, a plurality of funnels extending from the rear plate, a plurality of necks respectively extending from the funnels, a plurality of plate support members provided between the rear plate and the face plate to support the rear plate and the face plate against an atmospheric pressure, and a plurality of electron guns respectively provided in the necks, for dividedly scanning a plurality of regions of the phosphor screen by electron beams, is characterized by comprising steps of: manufacturing a rear envelope by integrally forming the rear plate and the plurality of funnels from one single plate glass; processing reference surfaces at predetermined positions on an inner surface of the rear plate, to be in contact with the plate support members; fixing ends of the plate support members to the reference surfaces, respectively; and joining the rear envelope to the face plate through the side wall by a joining material.

According to a cathode ray tube of the present invention constructed as described above and the manufacturing method thereof, it is possible to avoid variation of the heights of the plate support members by fixing the plate support members respectively to the reference surfaces formed on the rear plate. In this manner, it is possible to support effectively an atmospheric pressure load acting on the face plate and the rear plate and to realize a light-weight strong cathode ray tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Explanation will now be specifically made of a cathode ray tube and a manufacturing method thereof according to a first embodiment, with reference to the drawings.

Figure 1:
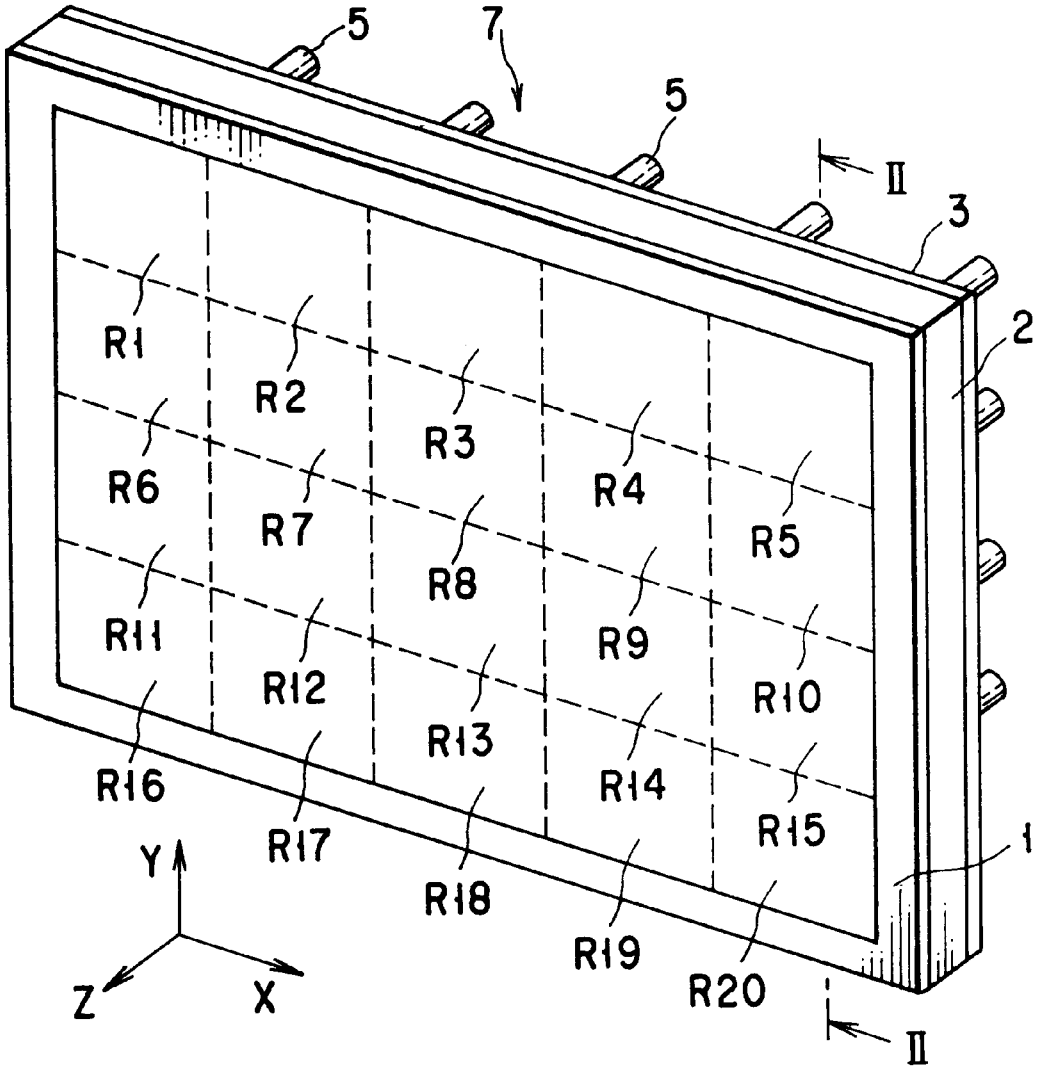
FIG. 1 is a perspective view showing cathode ray tube according to a first embodiment of the present invention.
Figure 2:
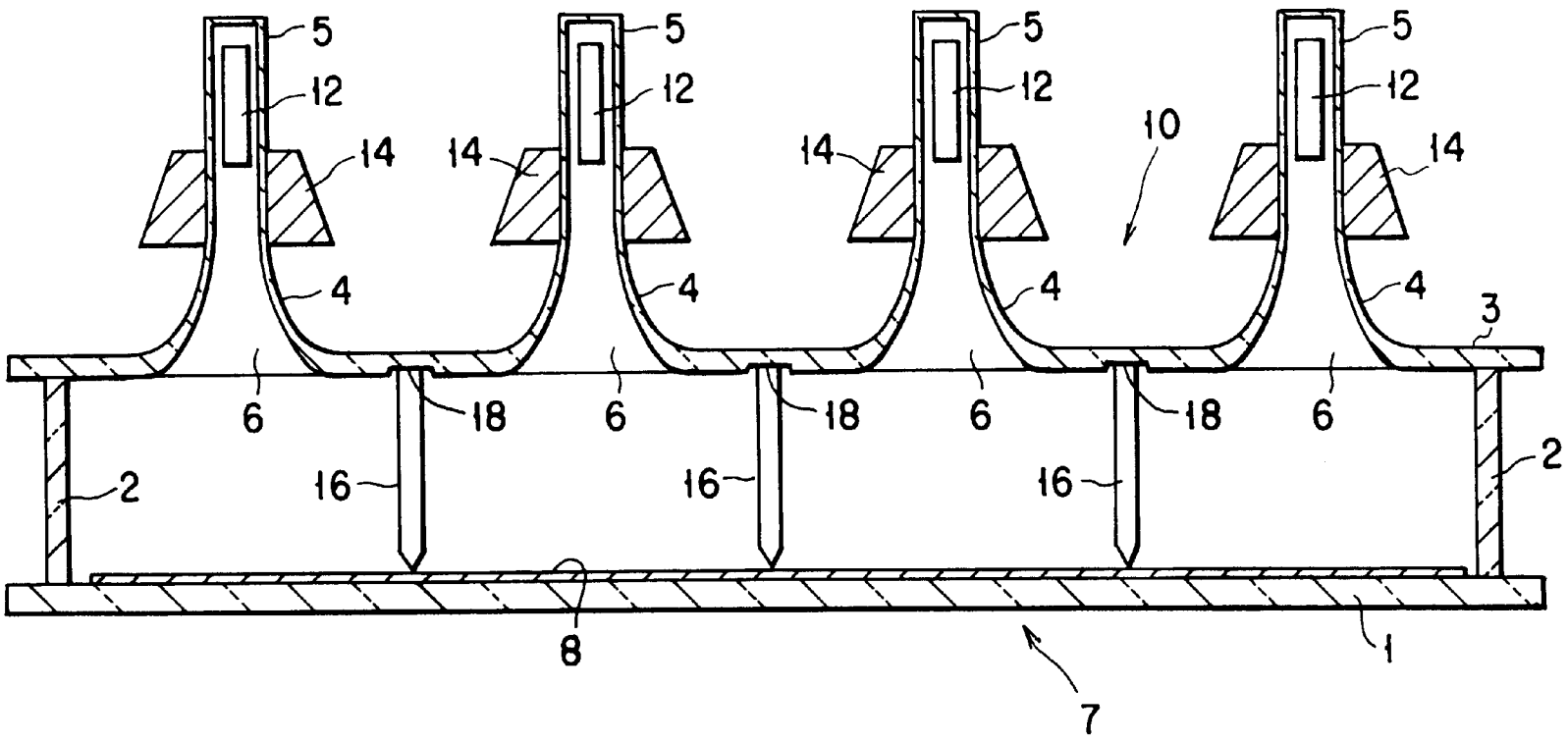
FIG. 2 is a cross-sectional view taken along a line II—II in FIG. 1.

As shown in FIGS. 1 and 2, the cathode ray tube comprises a vacuum envelope 7 which has a substantially rectangular flat face plate 1 made of glass, a frame-like side wall 2 joined to the periphery of the face plate 1 by a joining material such as frit glass and standing to be substantially perpendicular to the face plate 1, a substantially rectangular flat rear plate 3 opposing in parallel to the face plate 1 and joined to the face plate through the side wall 2 by a joining material such as frit glass, and a plurality of funnels 4 extending backwards from the rear plate 3. The funnels 4 are arranged in a matrix array and are, for example, total twenty funnels arranged in five rows in the horizontal direction (or X-direction) and four columns in the vertical direction (or Y-direction).

The rear plate 3 and the plurality of funnels 4 are formed integrally of glass and constitute a rear envelope 10. An opening 6 of each funnel 4 is positioned in the same plane as the rear plate and is opposed to the inner surface of the face plate 1.

A phosphor screen 8 of an integrated structure is formed on the inner surface of the face plate 1 and the screen 8 includes stripe shaped three-color phosphor layers radiate in blue, green, and red, each extending in the vertical direction Y, and black stripes provided between the three-color phosphor layers.

In the neck 5 of each funnel 4 is arranged an electron gun 12 for emitting electron beams toward the phosphor screen 8. A deflector 14 is mounted on the outer circumference of each funnel 14.

Further, between the face plate 1 and the rear plate 3 of the vacuum envelope 7 are provided a plurality of plate support members 16 for supporting the face plate 1 and the rear plate 3 with respect to an atmospheric pressure applied thereto. Each plate support member 16 is made of a columnar metal rod. Each support member 16 has a distal end portion formed in a wedge-like shape, which is in contact with a black stripe of the phosphor screen 8. In particular, the plate support members 16 are respectively arranged such that their distal ends are in contact with cross-points of boundaries between adjacent scanning regions of the phosphor screen 8 described later. Each plate support member 16 has a base end portion which is in contact with a reference surface 18 formed at a predetermined position of the rear plate 3 and is fixed thereto by a frit glass.

By thus providing the plate support members 16 constructed as described above, sufficient atmospheric-pressure resistance can be obtained even if the face plate 1, the side wall 2, and the rear plate 3 are each made of glass having a plate thickness of 4 to 15 mm, and the weight of the vacuum envelope 7 can be greatly reduced.

In the cathode ray tube constructed as described above, electron beams emitted from the plurality of electron guns 12 are deflected by magnetic fields generated from the deflectors 14 mounted outside the funnels 4, respectively, to scan the phosphor screen 8 divided into a plurality of regions, e.g., total twenty regions R1 to R20 arranged in five rows in the horizontal direction and four columns in the vertical direction. Images displayed on the phosphor screen 8 by the divisional scanning are combined together by controlling signals applied to the electron guns 12 and the deflectors 14, and thus, a large image is reproduced over the entire surface of the phosphor screen 8 without seams and overlaps.

Next will be explained a method of manufacturing the structure described above.

Figure 3:
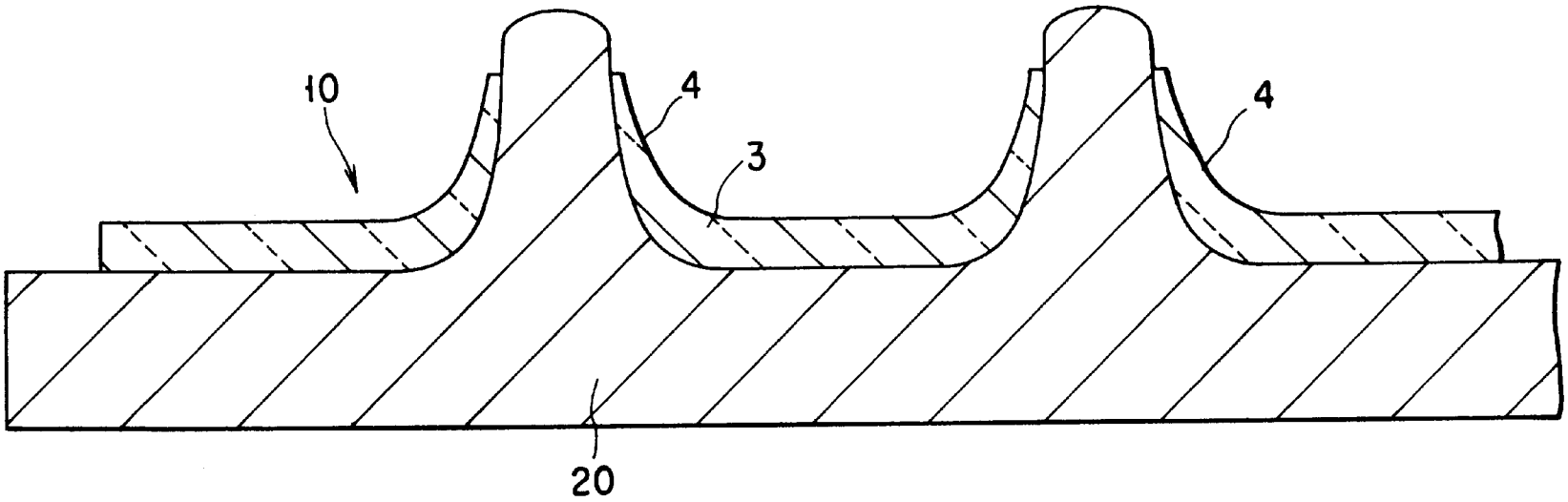
FIG. 3 is a cross-sectional view showing a manufacturing step of a rear envelope in the cathode ray tube.

At first, as shown in FIG. 3, a rectangular sheet of plate glass as a material for forming a rear envelope 10 is heated to a temperature equal to or higher than the softening point of glass, and the softened plate glass is fitted to a carbon shaping die 20 processed into a predetermined shape and is shaped along the surface of the shaping die. In this manner, the rear plate 3 and the funnels 4 are integrally formed. Each of the plurality of funnels 4 of the rear envelope 10 is formed into a funnel-like shape, and the glass forming each of the funnels 4 is thinned at regions of the necks.

Figure 4:
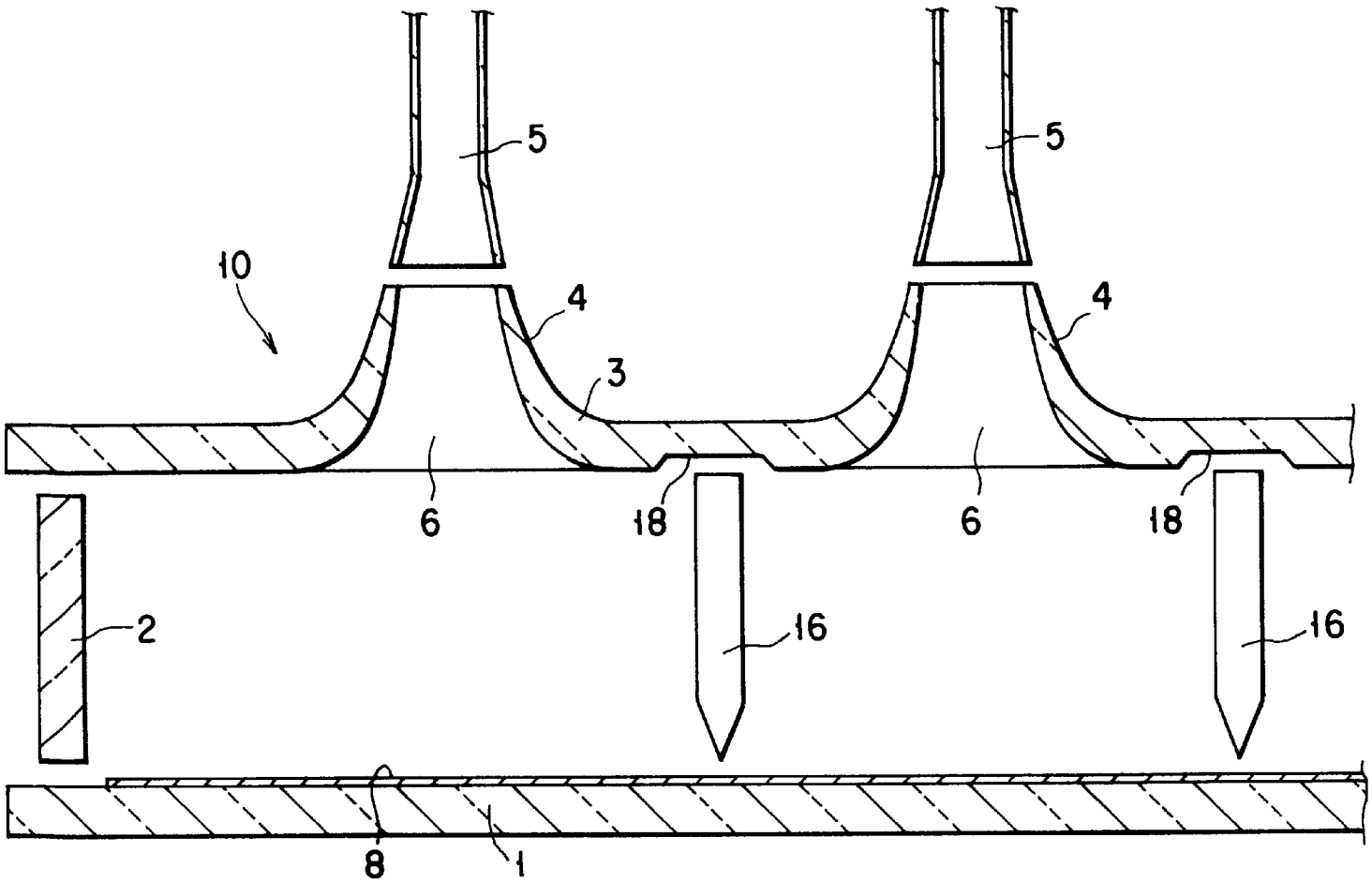
FIG. 4 is an exploded cross-sectional view showing the cathode ray tube.

Next, as shown in FIG. 4, those portions of the inner surface of the rear plate 3 where the plurality of plate support members 16 are provided are polished and the flat recessed reference surface 18 are processed such that all the surfaces 18 are positioned in one same plane. Subsequently, a neck 5 previously processed like a flare is connected to the distal end portion of each funnel 4. The funnels 4 and the necks 5 are connected to each other by burner heating.

Then, the plurality of plate support members 16 are positioned with respect to the reference surfaces 18 of the rear plate 3 by using a positioning jig, and the base ends of the plate support members 16 are fixed to the respective reference surfaces 18 by applying and sintering frit glass. The electron guns 12 are enclosed in the plurality of necks 5. Further, a phosphor screen 8 is formed on the face plate 1, and thereafter, the face plate 1, the side wall 2, and the rear envelope 10 are joined to be integral with each other by applying and sintering frit glass with use of an assembling jig, thereby to form a vacuum envelope 7. Thereafter, the vacuum envelope 7 is subjected to vacuum exhaustion, and deflectors 14 are installed, thus completing a cathode ray tube.

According to the cathode ray tube constructed as described above, the rear plate 3 and the plurality of funnels 4 are integrally formed of one single plate glass, so that a plurality of funnels 4 can be provided with a high precision, and finally, the positions of the electron guns 12 sealed in the necks 5 of the funnels can respectively be set with a high precision.

In the cathode ray tube wherein a plurality of divided images are formed on a screen, as in the present embodiment, courses of electron beams actually emitted from the electron guns must be aligned with the respective axes (or normal axes) passing through the centers of corresponding regions, in order to hide seams between the divided images on the screen.

To align accurately the courses of the electron beams, the positional relationship between the electron guns 12 and the necks 5, the positional relationship between the rear envelope 10 and the face plate 1 (or the phosphor screen), and the relative positional relationship between the plurality of funnels 4 with each other must all be set with high precision.

High precision can be easily maintained with respect to the positional relationship between the electron guns 12 and the necks 5, since the electron guns can be sealed in the necks while correcting the positions of the guns at a normal temperature. Also, high precision can be easily maintained with respect to the positional relationship between the rear envelope 10 and the face plate 1, by joining the rear envelope 10 and the face plate 1 together by frit glass while pressing outline-reference positions of the envelope and the plate (e.g., three positions for each of the envelope and the plate) against reference pads of a sintering tool, in a manner similar to that used in a step of sealing/connecting a panel and funnels of a conventional cathode ray tube.

Further, the positional relationship between the plurality of funnels 4 is the positional relationship between the funnels 4 and the rear plate 3 constituting the rear envelope 10. In the present embodiment, since the rear plate and the funnels are integrally formed from a plate glass, the positions of the funnels 8 relative to each other depend on the processing precision of the shaping die used for shaping the rear envelope 10. With such processing precision, normal mechanical processing precision can be maintained.

Formation of the rear envelope 10 is carried out at a temperature equal to or higher than the softening point of glass, and therefore, a position shift caused by thermal expansions of glass and the shaping die appears as a problem. Since the position shift thus caused is constant based on the formation temperature and is easy to manage, no practical problem will be caused if only the shaping die is designed by previously estimating a shift amount. The positional relationship between the funnels and the reference surfaces 18 formed on the inner surface of the rear plate of the rear envelope 10 can be corrected by polishing or the like when processing the reference surfaces 18 after formation of the rear envelope 10.

The courses of electron beams are determined depending on emission positions and the emission angles thereof. The emission positions are layout positions of the electron guns, and the emission angles receive various influences from the precision of electrode arrangement of the electron guns, external magnetic fields, and the like. Therefore, even if the axis of an electron gun 12 is arranged at a predetermined position, the course of the electron beam does not always correspond to a predetermined course.

In this respect, a method of correcting the course of the electron beam using a ring magnet has been adopted conventionally. By variously combining the correction method using the magnet, the course of the electron beam can be corrected to some extent. It is, however, important that deformation of the shape of the electron beam is caused if this correction is used too much, and for example, an image of a high resolution cannot be reproduced. The present inventors have found that the position precision of an electron gun needs to be set to approximately 0.5 mm or less, in order to make correction relatively easily with high precision without influencing the beam shape of the electron beam.

In order that the position precision of the electron guns 12 satisfies the above numerical value, the position shift amount caused by a difference between the thermal expansion amounts of the shaping die of the rear envelope 10 and a glass material must be equal to or less than the numerical value described above. An actual position shift amount of 0.1 mm or less can be obtained, and it is thus possible to realize an image display apparatus having a vacuum envelope with high precision.

Also, if the funnels 4 are formed to be integral with the rear panel 3, each of the boundary portions between the inner surfaces of the funnels 4 and the inner surface of the rear panel can be formed as a continuous smooth arc surface. Therefore, electron beams emitted from the electron guns 12 do not collide into the periphery of the openings of the openings 6, but an excellent image can be displayed efficiently.

Meanwhile, according to the present embodiment, the rear plate 3 and the funnels 4 are formed by heating a plate glass as a material for forming a rear envelope 10, to a temperature equal to or higher than the softening point of glass. In this case, a carbon shaping die processed into a predetermined shape is used and shaping is carried out such that a softened plate glass is fitted with the shape of the shaping die. This shaping accompanies a movement of a very large lump of glass, and shaping strain caused by the shaping is very large. The shaping strain (or residual strain) is conventionally removed by annealing processing performed after shaping of glass. This means a necessity of a step of gradually cooling the glass by maintaining the glass after shaping at a glass transition temperature or less. However, since the main surface of the rear plate 3 is flat and has a large area, and since the glass is relatively thin, the rear envelope 10 causes deformation such as curving or twisting of the rear plate even by a small residual strain.

Meanwhile, a plurality of plate support members 16 which support an atmospheric pressure load are provided at predetermined positions of the rear plate. However, it is difficult to fix the plate support members on the rear plate which once has caused deformation described above, with high precision. In particular, each plate support member 16 must be positioned at the boundary between adjacent regions of the phosphor screen, in the horizontal and vertical directions. Further, the height of the distal end portions of the plate support members 16 must be aligned with each other to efficiently support an atmospheric pressure load.

Although it is originally necessary to perfectly prevent deformation of the rear plate 3 after shaping from the respects described above, it can be said that a method of simply elongating the annealing time. Therefore, the present embodiment is based on a precondition that the inner surface of the rear plate 3 after shaping is not flat, and only the portions of the inner surface of the rear plate, which are necessary for positioning the plate support members 16, i.e., only the portions which are in contact with the base ends of the plate support members are polished to form a reference surface 18 having desired flatness.

Although it is possible to process all the inner surface of the rear plate 3, the rear plate having a thin glass main surface has only a low rigidity, so that the rear plate may be deformed easily by a contact with a large polishing head for polishing a large area, or inversely, deformation of the rear plate may be temporarily corrected. According to the present embodiment, only narrow regions which are in contact with the plate support members are processed to form reference surfaces 18 for fixing the plate support members. By thus processing narrow limited regions, it is possible to shorten the processing time and improve the manufacturing efficiency.

The diameter of each plate support member 16 is, for example, 8 mm and the diameter of the reference surface 18 to be polished is set to 10 mm. The depth to be polished must be greater than that portion of the main surface of the rear envelope which has the maximum deformation. The present inventors have measured and amounted maximum deformation portions and with a plurality of rear envelopes set on a measurement disk. The maximum deformation amount was substantially 1 mm or less. It has been found that about the depth of about 1 mm is sufficient for the reference surface 18 at most and portions which have only small deformation need not substantially be polished.

As has been described above, according to the present embodiment, the plurality of funnels are respectively provided at predetermined positions on the rear plate with high precision, by integrally forming the rear plate 3 and the plurality of funnels 4 from a plate glass to form the rear envelope. In this manner, the axes of the electron guns enclosed in the necks 5 of the funnels 4 can be aligned with the respective centers of the corresponding regions of the phosphor screen, and therefore, it is possible to provide a cathode ray tube capable of reproducing an excellent image without seams and overlaps over the entire phosphor screen. At the same time, joining portions of the vacuum envelope are reduced by integrally forming the rear plate and the funnels, so that the reliability concerning the withstand-voltage characteristics and the vacuum air density can be greatly improved. Simultaneously, materials and steps associated with joining are reduced so that manufacturing costs can be reduced.

In addition, by integrally forming the rear envelope 10, it is possible to prevent dislocations between the heights of the plate support members by polishing the contact portions with the plate support members to obtain a flattened reference surface 18, even when deformation is caused in the inner surface of the rear plate. In this manner, an atmospheric-pressure load acting on the vacuum envelope can be efficiently supported by the plate support members, so that a light-weighted strong cathode ray tube can be realized.

In the embodiment described above, the necks are previously processed to be flared and are then welded to the funnels by using a burner when the necks 5 are joined to the funnels 4. This method is effective when funnels are formed from a thick plate glass or when necks having a small thickness are welded to funnels. However, the necks need not always be flared but various methods can be selected in consideration of the process-ability of the necks.

Although explanation has been made of a method of processing the reference surface 18 so as to be recessed, the shape of the reference surface 18 is not limited to a recessed shape as long as the portions which are in contact with the plate support members 16 are formed to be flat. Further, another component material may be layered on the rear plate, and the upper surface of the component material may be used as a reference surface.

In the first embodiment described above, the rear envelope 10 is constituted by a rear plate 3 and a plurality of funnels 4 which are integrally formed. However, the rear envelope 10 may further include the side wall 2. Specifically, the rear plate 3, the funnels 4, and the side wall 2 may be formed integrally with one another without using a joining material.

Figure 5:
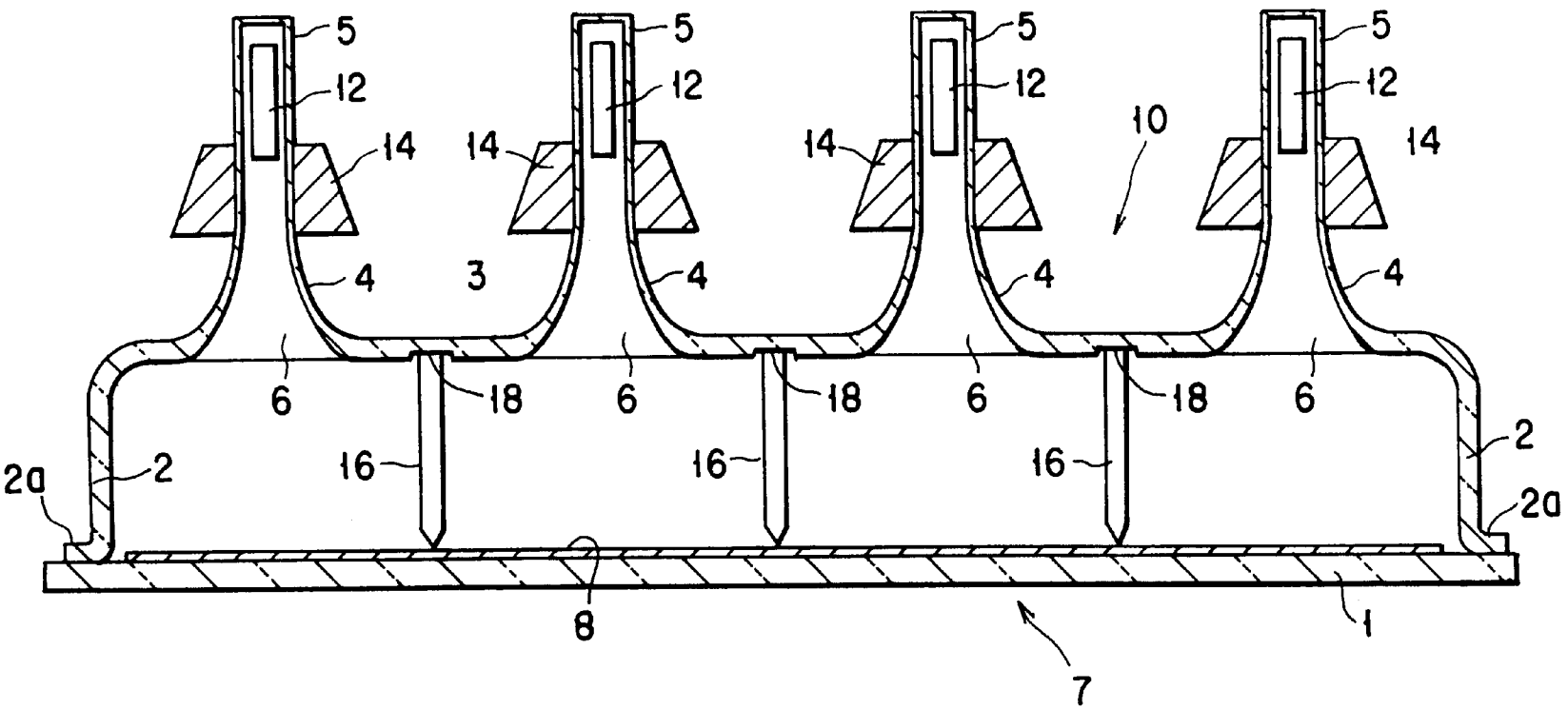
FIG. 5 is a cross-sectional view of a cathode ray tube according to a second embodiment of the present invention.

FIG. 5 shows a cathode ray tube according to a second embodiment of the present invention, in which a rear envelope 10 is an integral structure consisting of a rear plate 3, funnels 4, and a side wall 2, and is joined to a face plate 1 by a joining material, thereby forming a vacuum envelope. The end portion of the side wall 2 on the face plate side is bent outwards at substantially right angles, forming a flange 2*a*. Further, the vacuum envelope 7 is formed by joining the flange 2*a* to the face plate 1 by frit glass.

The rest of the structure of the second embodiment is the same as that of the first embodiment. Those components which are the same as in the first embodiment are referred to by the same reference numerals, and detailed explanation of those components will be omitted.

Figure 6:
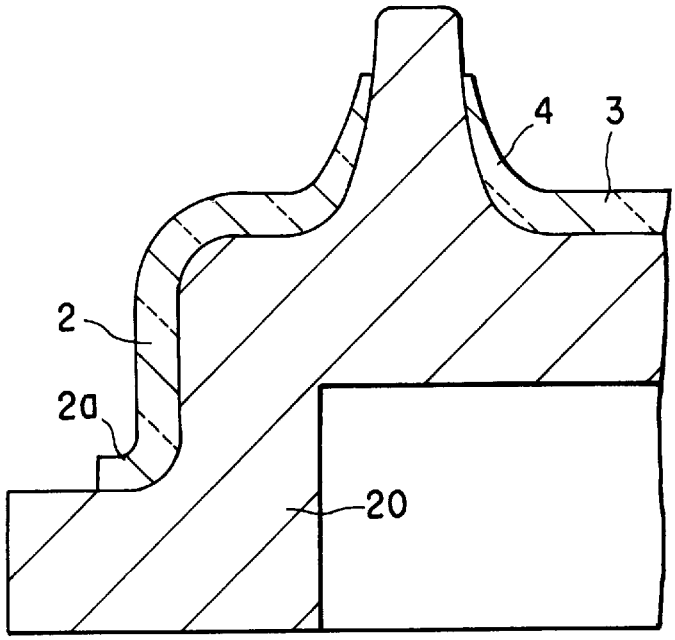
FIG. 6 is a cross-sectional view showing a manufacturing step of a rear envelope of the cathode ray tube according to the second embodiment.

In case of manufacturing a cathode ray tube comprising the rear envelope 10 constructed as described above, a sheet of plate glass 40 as a material for forming the rear envelope 10 is heated to a temperature equal to or higher than the softening point of glass and is softened thereby, as shown in FIG. 6. The softened plate glass is brought into contact with a carbon shaping die 20 processing into a predetermined shape, and is shaped along the shaping die. In this manner, a rear envelope 10 integrally comprising a rear plate 3, a plurality of funnels 4, and a side wall 2 is formed. Each of the plurality of funnels 4 of the rear envelope 10 is formed in a funnel-like shape and is thinned at the region of its neck.

Figure 7:
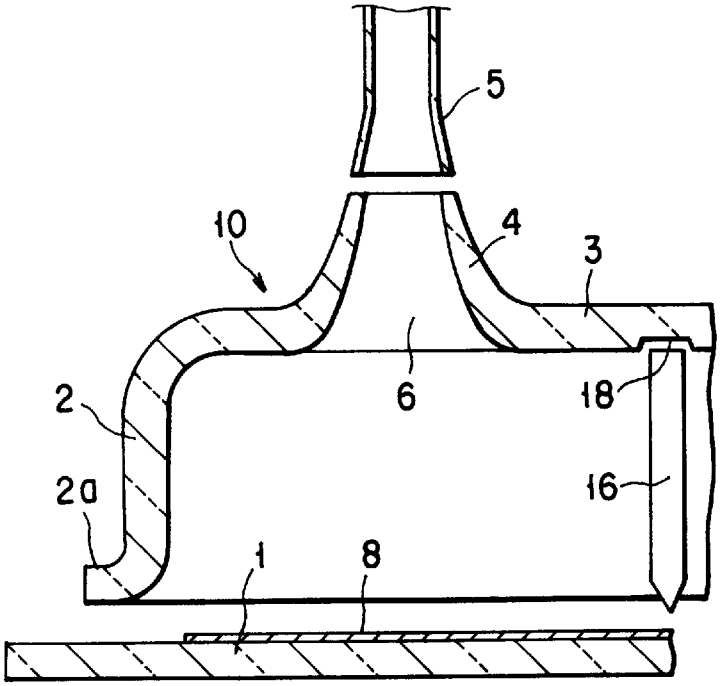
FIG. 7 is an exploded cross-sectional view showing the cathode ray tube according to the second embodiment.

As shown in FIG. 7, those portions of the rear plate 3 where a plurality of plate support members 16 are to be attached are polished and a recessed reference surface 18 is processed. Subsequently, necks 5 previously processed like a flare are connected to top end portions of the funnels 4. The funnels 4 and necks 5 are connected by welding by burner-heating.

Thereafter, using a positioning jig not shown, a plurality of plate support members 16 are positioned with respect to the reference surface 18 of the rear plate 3, and the base ends of the plate support members 16 are fixed to the reference surfaces 18 by applying and sintering frit glass. In addition, the electron guns 12 are sealed in the plurality of necks 5. Further, a phosphor screen 8 is formed on the inner surface of the face plate 1, and the peripheral portion of the inner surface of the face plate 1 is integrally joined to a flange 2*a* of the side wall 2 by applying and sintering frit glass, thereby forming a vacuum envelope 7. Thereafter, the vacuum envelope 7 is subjected to vacuum exhaustion and is equipped with deflectors 14, thus completing a cathode ray tube.

According to the cathode ray tube constructed as described above, it is possible to obtain the same advantages and effects as those of the first embodiment. Also, according to the present embodiment, since the side wall 2 is constructed in an integral structure in addition to the rear plate and the funnels, joining portions using a joining material are reduced much more so that a cathode ray tube with withstand voltage characteristics and vacuum-air-tightness improved much more can be obtained. At the same time, materials and manufacturing steps associated with joining are reduced so that manufacturing costs can be reduced much more.

Further, according to the present embodiment, the end portion of the side wall 2 is bent outwards to form the flange 2*a*. Therefore, the contact area between the side wall 2 and the face plate 1 is increased, so that a sufficient joining width can be obtained and flatness of contact portions therebetween can be maintained.

Figure 8:
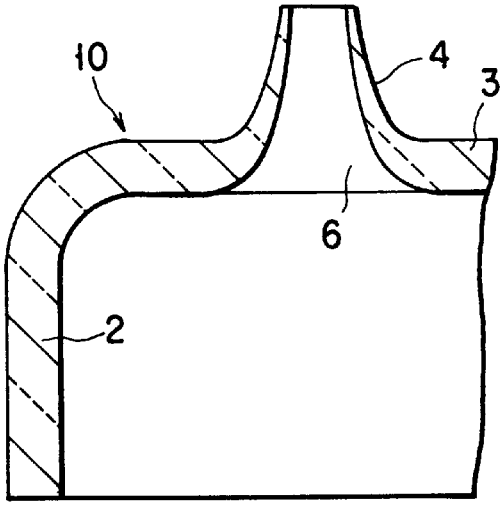
FIG. 8 is a cross-sectional view showing a modification of the cathode ray tube according to the second embodiment.

Note that the end portion of the side wall 2 needs not always be formed like a flange but may be formed linearly, as shown in FIG. 8. In this structure, also, it is possible to obtain advantages and effects substantially equal to those of the second embodiment.

Although the second embodiment adopts a structure in which the rear plate 3, the funnels 4, and the side wall 2 are integrally formed of a sheet of plate glass, a rear envelope of an integral structure may be formed by welding the rear plate and funnels integrally formed of a sheet of plate glass and the side wall formed of another plate glass to each other.

Figure 9:
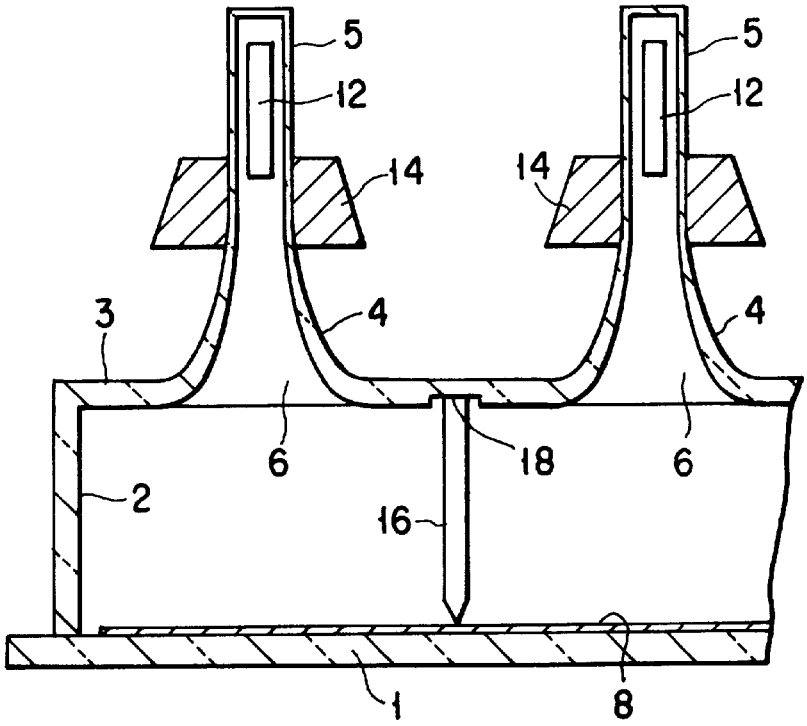
FIG. 9 is a cross-sectional view showing a cathode ray tube according to a third embodiment of the present invention.

According to a cathode ray tube of a third embodiment shown in FIG. 9, the rear envelope 10 is formed as an integral structure including a rear plate 3, funnels 4, and a side wall 2. In this case, the side wall 2 is integrated with the rear plate 3 by welding.

The cathode ray tube comprising such a rear envelope 10 is manufactured by the method as follows.

Figure 10:
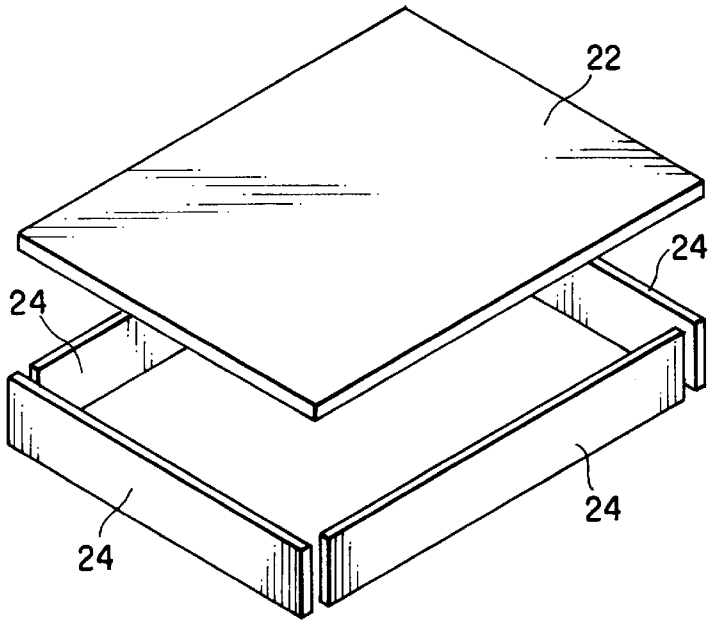
FIG. 10 is an exploded perspective view showing plate glass used for manufacturing a rear envelope of the cathode ray tube according to the third embodiment.

As shown in FIG. 10, the rear envelope 10 is processed from a sheet of rectangular plate glass 22 as a material for a rear plate 3 and a plurality of funnels (not shown), and four long sheets of rectangular plate glasses 24 as materials for a side wall 2. The plate glass 22 is formed to have a size substantially equal to the face plate 1. Each of the plate glasses 24 has a strip shape, and two of these glasses are prepared for short edge sides while the other two are prepared for long edge sides.

Figure 11:
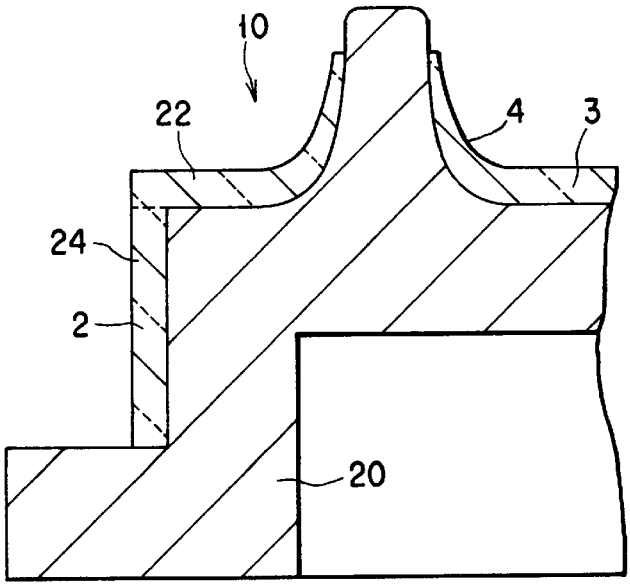
FIG. 11 is a cross-sectional view showing a manufacturing step of a rear envelope according to the third embodiment.

Subsequently, these five glasses 22 and 24 are heated to a temperature equal to or higher than the softening point of glass and are softened thereby. Thereafter, as shown in FIG. 11, the softened glasses are positioned along a shaping die 20 made of a heat-resistive material such as carbon or the like. In this manner, funnels and a rear plate 3 are formed from the plate glass 22, and end portions of the four plate glasses 24 are welded to each other. Simultaneously, the four plate glasses 24 are welded to the peripheral portion of the inner surface of the plate glass 22. In this manner, a rear envelope 10 having an integrated structure comprising the rear plate 3, the plurality of funnels, and the side wall 2.

Thereafter, joining of the necks, joining of the plate support members 16, formation of the phosphor screen, joining of the face plate, exhaustion, and installation of the deflectors are carried out in a manner similar to the embodiment described above, and thus, a cathode ray tube is manufactured.

According to the third embodiment constructed as described above, it is possible to obtain the same advantages and effects as those of the second embodiment described above. In addition, according to the present embodiment, since the side wall 2 is not formed as a part of the rear plate 3 under a high temperature, but is formed by welding together four sheets of plate glasses 24 each previously cut into a strip-like shape. Therefore, it is possible to form the rear envelope more easily in comparison with the second embodiment.

Specifically, in case of forming a rear plate, funnels, and a side wall by shaping one sheet of plate glass, the side wall can be processed by bending the plate glass, and therefore, the rear envelope can be formed efficiently. However, glass is excessive at bending portions, e.g., at corner portions, and such excessive glass must be released to the periphery during the bending processing or cut out later. The excess of glass increases in proportion to the height of the side wall. Therefore, the manufacturing method shown in the second embodiment is rather effective where the side wall is low, but this method requires a long annealing time where the side wall is high since the thickness distribution of glass is rendered ununiform due to excessive glass, thereby making the heat capacity ununiform.

In contrast, according to the third embodiment, the side wall is formed of plate glasses specialized as side plates by cutting out only necessary portions. No excessive glass remains after the manufacturing steps, and it is possible to provide a manufacturing method suitable for manufacturing a cathode ray tube having a high side wall. Also, according to the present embodiment, glass needs to have only a viscosity substantially enough to self-welding and processing can be carried out at a relatively low temperature, since processing for greatly deforming a plate glass is not required.

Figure 12:
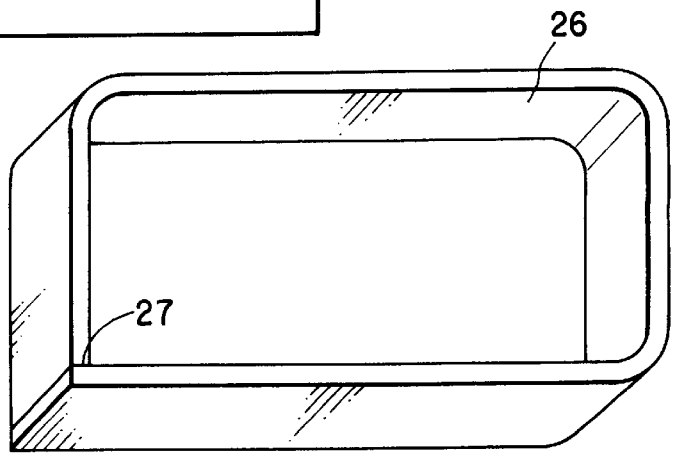
FIG. 12 is a perspective view showing a plate glass used for manufacturing a rear envelope of a cathode ray tube according to a fourth embodiment.

Although the third embodiment described above is constructed in a structure in which four plate glasses are used to form a side wall, it is possible to form the side wall by bending a long strip-like plate glass 26 as in the following fourth embodiment shown in FIG. 12.

Specifically, the plate glass 26 is shaped to have a length substantially equal to the total length of the side wall 2. Further, as shown in FIG. 12, the plate glass 26 heated to a high temperature is bent and processed into a rectangular frame-like shape, and the end portions of the plate glass 26 are brought into contact with each other. In this case, the plate glass 26 is heated at the vicinities of the bending portions by a burner and is bent into a predetermined shape by a metallurgical jig.

Subsequently, like in the third embodiment, a rectangular sheet of plate glass as a material for forming a rear plate 3 and the plate glass 26 processed and bent as described above are heated to a temperature equal to or higher than the softening point of glass and are softened thereby. Thereafter, the softened glasses are positioned along the surface of a shaping die made of a heat-resistive material. In this manner, a rear plate 3 comprising funnels 4 is formed from a sheet of plate glass, and the end portions 27 of the plate glass 26 are welded to each other. Simultaneously, the plate glass 26 is welded to the peripheral portion of the inner surface of the rear plate. In this manner, a rear envelope 10 of an integral structure comprising the rear plate 3, the plurality of funnels, and the side wall 2 is formed.

The rest of the structure of the present embodiment is the same as the third embodiment. In the fourth embodiment constructed as described above, it is possible to obtain the same advantages and effects as those of the third embodiment.

The present invention is not limited to the embodiments described above, but may further be modified within the scope of the invention. For example, the present invention is applicable to a cathode ray tube adopting a different method, such as a cathode ray tube comprising a shadow mask, a cathode ray tube of a beam index type, or the like, although the above embodiments have been explained with reference to a cathode ray tube having no shadow mask.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube comprising:

an envelope including a substantially rectangular flat face plate having a phosphor screen formed on an inner surface thereof, a substantially rectangular flat rear plate opposed to the face plate with a frame-like side wall interposed therebetween, a plurality of funnels extending from the rear plate, and a plurality of necks respectively extending from the funnels; and a plurality of electron guns arranged in the respective necks, for dividedly scanning the plurality of regions of the phosphor screen;

wherein the rear plate and the plurality of funnels are integrally formed of a single plate glass and the side wall is formed to be integral with the rear plate and the funnels, thereby forming a rear envelope, and the side wall of the rear envelope is joined to the face plate.

2. A cathode ray tube according to claim 1, wherein the rear plate, the plurality of funnels, and the side wall are integrally formed of a single plate glass and constitute the rear envelope.

3. A cathode ray tube according to claim 2, wherein the side wall includes a flange bent outwards and joined to the face plate.

4. A cathode ray tube according to claim 1, wherein the side wall includes four rectangular plate glasses welded to the rear plate and welded to each other.

5. A cathode ray tube according to claim 1, wherein the side wall consists of an elongate rectangular plate glass bent in a frame-like shape and welded to the rear plate.

6. A cathode ray tube according to claim 1, further comprising a plurality of plate support members provided between the rear plate and the face plate, for supporting the rear plate and the face plate against an atmospheric pressure, and wherein the rear plate includes a substantially rectangular inner surface opposing the face plate, and a plurality of reference surfaces formed on the inner surface, to which ends of the plate support members are respectively fixed.

7. A cathode ray tube according to claim 6, wherein the plurality of reference surfaces are formed by polishing the inner surface of the rear plate and are positioned in the same plane.

8. A cathode ray tube according to claim 1, wherein a boundary between an inner surface of the rear plate and an inner surface of each of the funnels is formed in a continuous arc-like shape.

9. A method of manufacturing a cathode ray tube comprising a substantially rectangular flat face plate having a phosphor screen formed on an inner surface thereof, a substantially rectangular flat rear plate opposed to the face plate with a frame-like side wall being interposed therebetween, a plurality of funnels extending from the rear plate, a plurality of necks respectively extending from the funnels, and a plurality of electron guns respectively arranged in the necks, for dividedly scanning a plurality of regions of the phosphor screen by electron beams, the method comprising the steps of:

heating and softening a single plate glass having a size substantially equal to the face plate;

manufacturing a rear envelope by integrally forming the rear plate and the plurality of funnels, by positioning the softened plate glass along a shaping die having a predetermined shape; and joining the rear envelope to the face plate through the side wall by using a joining material.

10. A method of manufacturing a cathode ray tube comprising a substantially rectangular flat face plate having a phosphor screen formed on an inner surface thereof, a substantially rectangular flat rear plate opposed to the face plate with a frame-like side wall being interposed therebetween, a plurality of funnels extending from the rear plate, a plurality of necks respectively extending from the funnels, and a plurality of electron guns respectively arranged in the necks, for dividedly scanning a plurality of regions of the phosphor screen by electron beams, the method comprising the steps of:

manufacturing a rear envelope by integrally forming the rear plate, the plurality of funnels, and the side wall from glass; and joining the side wall of the rear envelope to the face plate by using a joining material.

11. A method according to claim 10, wherein the step of manufacturing the rear envelope includes a step of integrally forming the rear plate, the plurality of funnels, and the side wall, from a single glass plate.

12. A method according to claim 10, wherein the step of manufacturing the rear envelope includes a step of integrally forming the rear plate and the plurality of funnels from a single plate glass, a step of welding four rectangular plate glasses to each other to form the frame-like side wall, and a step of welding and integrating the frame-like side wall to the rear plate.

13. A method according to claim 10, wherein the step of manufacturing the rear envelope includes a step of integrally forming the rear plate and the plurality of funnels from a single plate glass, a step of bending an elongate rectangular plate glass into a frame-like shape to form the frame-like side wall, and a step of welding and integrating the frame-like side wall to the rear plate.

14. A method of manufacturing a cathode ray tube comprising a substantially rectangular flat face plate having a phosphor screen formed on an inner surface thereof, a substantially rectangular flat rear plate opposed to the face plate with a frame-like side wall inserted therebetween, a plurality of funnels extending from the rear plate, a plurality of necks respectively extending from the funnels, a plurality of plate support members provided between the rear plate and the face plate to support the rear plate and the face plate against an atmospheric pressure, and a plurality of electron guns respectively arranged in the necks, for dividedly scanning a plurality of regions of the phosphor screen by electron beams, the method comprising steps of:

manufacturing a rear envelope by integrally forming the rear plate and the plurality of funnels from a single plate glass;

processing reference surfaces at predetermined positions on an inner surface of the rear plate, to be in contact with the plate support members;

fixing ends of the plate support members to the reference surfaces, respectively; and joining the rear envelope to the face plate through the side wall by using a joining material.

* * * * *